US006576074B1

(12) United States Patent
Cabrera et al.

(10) Patent No.: US 6,576,074 B1
(45) Date of Patent: Jun. 10, 2003

(54) PAVEMENT MARKING SYSTEM

(75) Inventors: Raul J. Cabrera, Marietta, GA (US); Steve L. Garren, Arlington Heights, IL (US); William E. Floor, Lawrenceville, GA (US)

(73) Assignee: Avery Dennison Corporation, Pasadena, CA (US)

( * ) Notice: Subject to any disclaimer, the term of this patent is extended or adjusted under 35 U.S.C. 154(b) by 119 days.

(21) Appl. No.: 09/757,148

(22) Filed: Jan. 9, 2001

(51) Int. Cl.[7] ..... B32B 31/00
(52) U.S. Cl. ..... 156/71; 404/12; 404/13
(58) Field of Search ..... 156/71; 404/12, 404/13

(56) References Cited

U.S. PATENT DOCUMENTS

| | | | | | |
|---|---|---|---|---|---|
| 1,664,070 | A | * | 3/1928 | Foster | 404/13 |
| 3,836,275 | A | * | 9/1974 | Finch | 404/13 |
| 3,902,939 | A | | 9/1975 | Eigenmann | |
| 4,082,587 | A | | 4/1978 | Eigenmann | |
| 4,376,007 | A | | 3/1983 | Eigenmann | |
| 4,652,172 | A | * | 3/1987 | Eigenmann | 156/71 |
| 4,687,369 | A | * | 8/1987 | McDonald | 116/63 P |
| 4,708,518 | A | | 11/1987 | Eigenmann | |
| 4,854,771 | A | | 8/1989 | Corbin, Jr. et al. | |
| 4,988,555 | A | | 1/1991 | Hedblom | |
| 5,242,242 | A | * | 9/1993 | Young | 404/12 |
| 5,422,380 | A | * | 6/1995 | Mendelsohn et al. | 521/107 |
| 5,980,664 | A | * | 11/1999 | Wilson, Sr. | 156/71 |
| 6,051,297 | A | * | 4/2000 | Maier et al. | 427/136 |
| 2001/0041091 | A1 | * | 11/2001 | Coleman | 404/9 |

FOREIGN PATENT DOCUMENTS

| | | |
|---|---|---|
| WO | WO9925928 | 5/1999 |

OTHER PUBLICATIONS

Article regarding "Application of HotTape® Precut Symbols and Legends", Bulletin HT2200, Oct. 1998.
Wondermat advertisement; Popcorn International Inc. Aliso Viejo, CA. 1996.*

* cited by examiner

*Primary Examiner*—Mark A. Osele
(74) *Attorney, Agent, or Firm*—Jones Day

(57) ABSTRACT

A pavement marking system is disclosed comprising a legend layer and a background layer of a contrasting color, preferably black. The background layer has edges that extend beyond the edges of the legend layer such that the background layer prevents contact of the legend layer by coating materials during surface treatments of the surrounding pavement surface.

34 Claims, 1 Drawing Sheet

PAVEMENT MARKING SYSTEM

FIELD OF THE INVENTION

This invention relates to a pavement marking system used to provide a graphic or legend on a pavement surface. More particularly, this invention relates to a pavement marking system used to provide a graphic or legend on a pavement surface that is subject to frequent resurfacing treatments, such as asphalt pavement surfaces in parking lots.

BACKGROUND OF THE INVENTION

It is known to provide markings on pavement surfaces to give visual information to drivers of vehicles thereon. Such markings are typically in the form of lane striping and parking space lines. It is also known to provide other graphics or legends on pavement surfaces, such as turn arrows, speed limit information, "Enter" and "Exit" words, and the like.

Such visual indicia commonly are provided as paint applied directly to the pavement surface. Such painted indicia fade and wear away with time, and such painted indicia must be repainted on a regular basis, resulting in greater expenditures of materials, labor, and time, as well as the inconvenience of having to close off the pavement area while the paint is applied and is allowed to dry. As an alternative to paint, it is known to provide lane striping in the form of a tape material secured to a roadway surface with a primer material as disclosed in U.S. Pat. Nos. 3,902,939, 4,082,587, 4,376,007, 4,708,518, or in the form of a preformed material applied directly to a roadway surface, as disclosed in U.S. Pat. No. 4,854,771. Other pavement marking materials are disclosed in U.S. Pat. No. 4,988,555, and in PCT publications WO 99/04099 and WO 99/25928.

Another type of preformed pavement marking product is preformed thermoplastic pavement marking materials sold by the assignee herein under the trademark "HOTape."® These materials are available in bright colors as either straight line goods or as specialty graphics, such as corporate logos, handicap logos, and word forms such as "Drive Thru" and "Thank You." These products are supplied as pre-cut pre-formed thermoplastic pieces, which are easily installed on a pavement surface, such as by fusing in place with a propane-fueled magnum heat gun or flame torch. The bright colors and durability of these products make them especially useful in commercial parking lots where the graphics are used to establish a corporate identity, such as parking lots and restaurant drive-through lanes.

One impediment to the use of such graphic marking systems on asphalt parking lots is the problems that arise when such parking lots require surface treatments or resurfacing. Asphalt parking lots must be surface treated more frequently than conventional roadways. Such surface treatments typically involve the application to the entire surface of the parking lot of a layer of a black coating such as asphalt, simulated asphalt, paint, or other materials used in pavement maintenance. First, a thick bead of the black coating is placed generally around the perimeter of the parking lot and spread such as with a "squeegee" to the edges of the lot. The interior surface of the lot is then sprayed with the black coating. Because the black coating has already been spread to the edges of the lot perimeter, it is not necessary to spray the black coating all the way to the edges of the lot, and adjacent areas such as concrete or grass are thereby protected from staining or other damage by the sprayed black coating.

It is not practical, however, to manually outline with the black coating along the edges of thermoplastic legends or images already on the parking lot surface in the form of words, numbers, corporate logos, and the like. When the interior surface of a parking lot having such thermoplastic surface markings is treated with a black coating, then either the area having such markings is not treated with the black coating, by placing a shield or cover over the legend or image, or else the black coating is applied over the entire surface including the thermoplastic markings, in which case the thermoplastic markings could become discolored or otherwise damaged by the black coating.

It is therefore an object of the invention to provide a pavement marking system suitable for providing legends such as corporate or other logos or alphanumeric information on pavement surfaces that from time to time require surface treatments such as a black coating.

SUMMARY OF THE INVENTION

The instant invention relates to a pavement marking system for providing a visible legend on a pavement surface, the system comprising a background layer of a thermoplastic material in the form of pre-cut, preformed thermoplastic for providing a contrasting background color for the visible legend, the background layer being adapted to be affixed to a pavement surface, and a legend layer comprising at least one piece of pre-cut, preformed thermoplastic in a color contrasting with the color of the background layer, the legend layer capable of being affixed in cooperation with the background layer to provide a visible message on a pavement surface. The legend layer is affixed in cooperation with the background layer to the extent that the legend layer can be applied either directly to the background layer, or it can be applied to the pavement surface in an in-laid manner through precut holes of corresponding size and shape in the background layer. Preferably, the outer edge of the background layer defines a simple geometric shape such as a square, rectangle, or circle, depending on the shape of the associated legend, and preferably the color of the background layer is black. When an asphalt area such as a parking lot and having thereon a pavement marking system of the instant invention is surface treated with a black coating, the black coating can be applied on the pavement surface up to and slightly over the edge of the background layer, without contacting the legend layer. The black coating can then be applied to the remainder of the asphalt surface without coming in contact with any part of the legend layer.

DETAILED DESCRIPTION OF THE INVENTION

Figure 1:
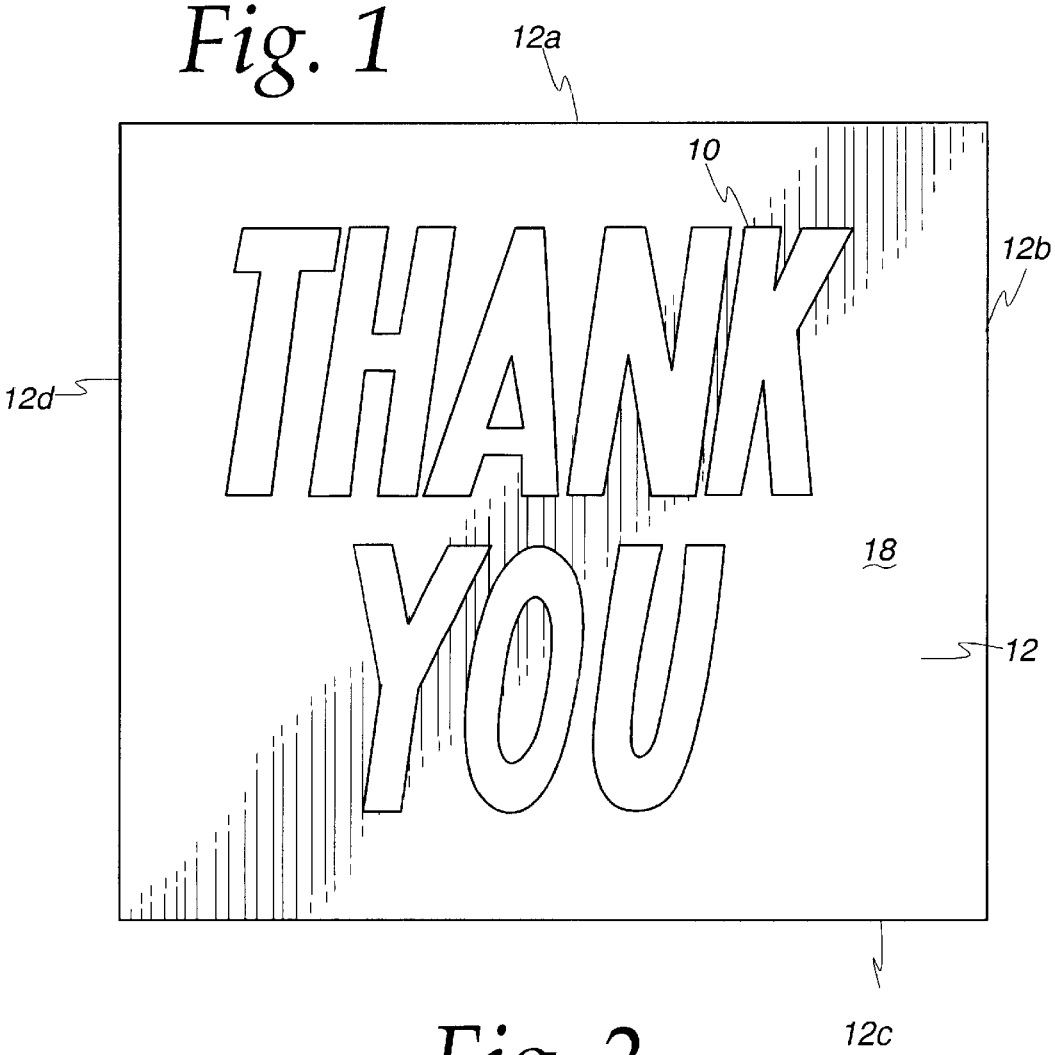
FIG. 1 is a top plan view of a pavement marking system of the instant invention applied to a pavement surface.

FIG. 1 illustrates a top plan view of a pavement marking system of the instant invention for use in conveying the message "THANK YOU", such as might be used on the pavement surface at the automobile exit point of a fast-food restaurant drive-through lane. In this embodiment of the invention, the legend layer 10 comprises each individual letter of the message "THANK YOU", although for clarity in the drawing the reference numeral has a reference line to only one such letter. Each letter of the legend layer is a precut piece of preformed thermoplastic material in one or more colors that contrasts with the color of background layer 12.

Background layer 12 is a separate piece of pre-cut preformed thermoplastic material having outer edges 12*a*, 12*b*, 12*c*, and 12*d*, and being of a color that contrasts with legend layer 10. Background layer 12 can be applied to the associated pavement surface by known means such as appropriate adhesives or fusing in place with a heat gun or flame torch.

Figure 2:
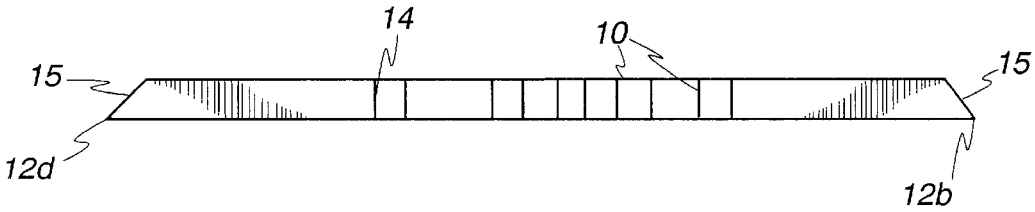
FIG. 2 is a cross-sectional view of one embodiment of a pavement marking system of the instant invention as applied to a pavement surface.
Figure 3:
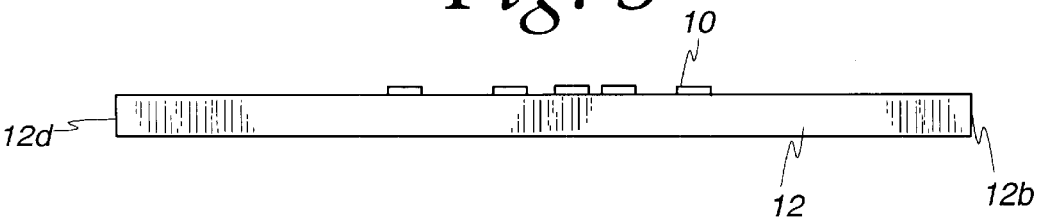
FIG. 3 is a cross-sectional view of an alternative embodiment of the pavement marking system of the instant invention as applied to a pavement surface.

FIGS. 2 and 3 are cross-sectional views of alternative embodiments of the pavement marking system of FIG. 1. In the embodiment of FIG. 2, background layer 12 is provided with a plurality of orifices 14, only one of which is indicated in the drawing for sake of clarity, each orifice 14 being pre-cut to correspond in size and shape with one of the letters of legend layer 10. For installation, background layer 12 is placed on the pavement surface where installation is desired, and is affixed thereto such as with an adhesive or by fusing with a heat gun or flame torch. The pre-cut letters of legend layer 10 are then placed in an in-laid manner within the precut orifices 14 of background layer 12, and affixed to the pavement surface by any of the same techniques, i.e., adhesives or by fusing with a heat gun or flame torch. Alternatively, background layer 12 can be placed on the pavement surface and the letters of legend layer 10 placed in their corresponding orifices 14 in background layer 12; then the legend layer and background layer can be affixed to the pavement surface simultaneously, such as by fusing with a flame torch.

The embodiment of FIG. 2 may be preferred in those applications in which it is desirable that the top surface of the legend layer 10 of the pavement marking system be substantially flush with the top surface of the background layer 12. Such applications can include those applications in which the pavement surface may be subjected to snowplowing. In such applications, it also may be desirable for the regions of background layer 12 adjacent to outer edges 12*a*, 12*b*, 12*c*, and 12*d* to be provided with a chamfer 15, to reduce the likelihood of a snowplow blade prying into background layer 12 and tearing or dislodging it.

In the embodiment of FIG. 3, there are no orifices in background layer 12 corresponding to each of the letters of legend layer 10. Instead, the letters of legend layer 10 are simply applied directly onto the top surface of background layer 12. For installation, background layer 12 is placed on the pavement surface where installation is desired, and is affixed thereto such as with an adhesive or by fusing with a heat gun or a flame torch. The pre-cut letters of legend layer 10 are then placed directly onto the top surface of background layer 12, and affixed thereto by any of the same techniques, i.e., adhesives or by fusing with a heat gun or flame torch. Further, although no chamfered edge 15 is illustrated in FIG. 3, it will be appreciated that this optional feature could be included in the embodiment of FIG. 3 if desired.

Use of the pavement marking system of the instant invention greatly facilitates the surface treatment of the associated pavement such as with a black coating. If the area of the background layer 12 between the edge of the legend layer 10 and the nearest edge 12*a*, 12*b*, 12*c*, or 12*d* of the background layer 12 is wide enough such as at 18, then the black coating can be applied right up to and slightly over those edges of background layer 12, without coming into contact with legend layer 10. Alternatively, the black coating can be applied to the pavement surface adjacent to the edges 12*a*, 12*b*, 12*c*, and 12*d* of background layer 12, and spread up to the edges and outwardly therefrom such as with a squeegee tool. The edges of background layer 12 preferably define a simple geometric shape to facilitate this step. In the embodiment of FIGS. 1–3, the shape of background layer 10 is generally rectangular, although the invention is not limited to such shapes. Black coating is then applied to the pavement surface up to and overlapping the previously applied black coating around the pavement marking system of the invention, so that the black coating does not have to come into contact with either the legend layer 10 or the background layer 12.

Background layer 12 is preferably black. This provides enhanced visual contrast with legend layer 10, particularly as the surrounding pavement surface fades over time to a light gray. Such enhanced visual contrast provides greater conspicuity of the message conveyed by the legend layer 10. A black background 12 also will not show any stains or discoloration should any black coating come in contact with the background layer.

In accordance with the invention, materials that can be used for background layer 12 and legend layer 10 include those materials used in certain preformed pavement marking products of the prior art and sold by the assignee herein under the trademark "HOTape." Such materials are durable, semi-flexible pre-cut pieces of pre-formed thermoplastic.

The shapes of either the background layer 12 or the legend layer 10 can be alphanumeric or geometric.

The thickness of either the background layer 12 or the legend layer 10 may range from about 60 mils to about 125 mils. The thickness of the two layers can be either the same or different, depending upon the needs of a particular installation.

The surface area sizes of either the background layer 12 or the legend layer 10 may vary at the option of the user.

The composition of either the background layer 12 or the legend layer 10 may comprise calcium carbonate filler in the amount of about 60–85 wt % and preferably about 70–80 wt %; a first thermoplastic resin such as an alkyd resin in the amount of about 7–15 wt % and preferably about 8–10 wt %; a second thermoplastic resin such as polyamide resin in the amount of about 5–10 wt % and preferably about 6–8 wt %; plasticizer in the amount of about 3–8 wt % and preferably about 4–6 wt %; cullets dropped on the top surface in the amount of about 1.5–5 wt % and preferably about 2–4 wt %; paraffin wax in the amount of about 1–4 wt % and preferably about 1.5–2.5 wt %; anti-oxidant in the amount of less than about 2 wt % and preferably less than about 1 wt % and pigment in the amount of less than about 5 wt % and preferably less than about 2 wt %.

The composition of either the background layer 12 or the legend layer 10 may comprise other materials that can serve as equivalents for those listed above. Suitable equivalents for the calcium carbonate filler material include talc, mica, barytes, fiberglass, glass beads, and cullets, all either alone or in any combination with or without calcium carbonate, and with one or more additives, suspending agents, thickeners, or extenders. Suitable equivalents for the alkyd resin include hydro resins, polyester resins, maleic resins, phenolic resins, epoxy resins, or acrylic resins and combinations thereof. Suitable equivalents for the polyamide resin include ethylene vinyl acetate resin, propylene vinyl acetate resin, and polystyrene. Suitable equivalents for paraffin wax include polyethylene wax and polypropylene wax, and combinations thereof. Other ingredients such as leveling agents, anti-corrosion agents and UV stabilizers can also be used.

The installation of both background layer 12 and legend layer 10 are described by the assignee in the brochure entitled "Application of HotTape Precut Symbols and Legends". As described therein, the area where the marking system is to be applied is measured and marked. The thermoplastic material is laid out on the pavement surface in the desired final position and outlined with chalk. The thermoplastic material is removed, and the pavement area within the chalk outline is heated. The thermoplastic material is placed on the heated pavement surface, and fused into place.

The installation of both background layer 12 and legend layer 10 may also be accomplished with the use of a suitable adhesive or the like.

Various modifications of the foregoing preferred embodiments will be apparent to those skilled in the art of thermoplastic pavement marking materials. Such modifications will be within the specified scope of the invention, as defined in the claims appended hereto.

We claim:

1. A pavement marking system for providing a visible legend on a pavement surface, the system comprising, a background layer comprising at least one pre-cut piece of thermoplastic material for providing a contrasting background for the visible legend, said background layer adapted to be affixed to the pavement surface, and a legend layer comprising at least one pre-cut piece of thermoplastic material in a color contrasting with the color of said background layer, said legend layer being adapted to be affixed in cooperation with said background layer to provide a visible message on a pavement surface, wherein said background layer comprises
a filler material,
a first thermoplastic resin,
a second thermoplastic resin,
plasticizer,
wax, and
pigment.

2. The pavement marking system of claim 1 wherein said legend layer is adapted to be affixed in cooperation with said background layer by being adapted to be affixed on the top surface of said background layer.

3. The pavement marking system of claim 1 wherein said background layer is provided with at least one pre-cut orifice therein corresponding in size and shape to said at least one pre-cut piece of thermoplastic material of said legend layer, and said legend layer is adapted to be affixed in cooperation with said background layer by being adapted to be affixed to the pavement surface through said at least one pre-cut orifice in said background layer.

4. The pavement marking system of claim 1 wherein the background layer has an outer edge that is chamfered with respect to the pavement surface.

5. The pavement marking system of claim 1 wherein the background layer has one or more outer edges that define a regular geometric shape.

6. The pavement marking system of claim 1 wherein said filler material is selected from the group consisting of calcium carbonate, talc, mica, barytes, fiberglass, glass beads, and cullets, and combinations thereof.

7. The pavement marking system of claim 6 wherein said filler material further comprises one or more additives selected from the group consisting of suspending agents, thickeners, or extenders.

8. The pavement marking system of claim 1 wherein said filler material is present in the amount of about 60–85 wt % of said background layer.

9. The pavement marking system of claim 8 wherein said filler material is present in the amount of about 70–80 wt % of said background layer.

10. The pavement marking system of claim 1 wherein said first thermoplastic resin is selected from the group consisting of alkyd resin, hydro resin, polyester resin, maleic resin, phenolic resin, epoxy resin, acrylic resin, and combinations thereof.

11. The pavement marking system of claim 1 wherein said first thermoplastic resin is present in the amount of about 7–15 wt %.

12. The pavement marking system of claim 11 wherein said first thermoplastic resin is present in the amount of about 8–10 wt %.

13. The pavement marking system of claim 1 wherein said second thermoplastic resin is selected from the group consisting of polyamide resin, ethylene vinyl acetate resin, propylene vinyl acetate resin, and polystyrene.

14. The pavement marking system of claim 1 wherein said second thermoplastic resin is present in the amount of about 5–10 wt %.

15. The pavement marking system of claim 14 wherein said second thermoplastic resin is present in the amount of about 6–8 wt %.

16. The pavement marking system of claim 1 wherein said plasticizer is present in the amount of about 3–8 wt %.

17. The pavement marking system of claim 16 wherein said plasticizer is present in the amount of about 4–6 wt %.

18. The pavement marking system of claim 1 wherein said wax is selected from the group consisting of paraffin wax, polyethylene wax, and polypropylene wax.

19. The pavement marking system of claim 1 wherein said wax is present in the amount of about 1–4 wt %.

20. The pavement marking system of claim 19 wherein said wax is present in the amount of about 1.5–2.5 wt %.

21. The pavement marking system of claim 1 wherein said pigment is present in the amount of less than about 0.5 wt %.

22. The pavement marking system of claim 1 wherein said background layer further includes anti-oxidant.

23. The pavement marking system of claim 1 wherein said background layer further includes one or more additives selected from the group consisting of leveling agents, anti-corrosion agents, and UV stabilizers.

24. A method of providing a visible message on a pavement surface, the method comprising (a) providing a background layer adapted to be affixed to a pavement surface, said background layer comprising a filler material, a first thermoplastic resin, a second thermoplastic resin, plasticizer, wax, and pigment, (b) affixing said background layer to said pavement surface, (c) providing a legend layer separate from said background layer and adapted to be affixed in cooperation with said background layer, and (d) affixing said legend layer in cooperation with said background layer to provide a pavement marking system.

25. The method of claim 24 wherein step (d) is accomplished by affixing said legend layer to the top of said background layer.

26. The method of claim 25 wherein said legend layer is affixed to said background layer by means of an adhesive.

27. The method of claim 25 wherein said legend layer is affixed to said background layer by means of fusing means.

28. The method of claim 24 wherein said background layer has at least one pre-cut orifice therethrough, and at least a portion of said legend layer is positioned within said at least one orifice, and step (d) is accomplished by affixing said legend layer to said pavement surface.

29. The method of claim 28 wherein said legend layer is affixed to said pavement surface by means of an adhesive.

30. The method of claim 28 wherein said legend layer is applied to said pavement surface by means of fusing means.

31. The method of claim 30 wherein said legend layer is positioned in said at least one orifice of said background layer prior to step (b), and steps (b) and (d) are accomplished in a single step.

32. The method of claim 24 wherein said background layer is affixed to said pavement surface by means of an adhesive.

33. The method of claim 24 wherein said background layer is affixed to said pavement surface by fusing means.

34. In a pavement marking system for providing a visible message on a pavement surface and including a legend layer that conveys a message to one viewing the pavement marking system, the improvement comprising a separate background layer of contrasting color and having an outer edge disposed substantially around and beyond the perimeter of said legend layer, said background layer comprising a filler material, a first thermoplastic resin, a second thermoplastic resin, plasticizer, wax, and pigment, said legend layer and said separate background layer being adapted to be affixed in cooperation with each other to a pavement surface to provide a visible marking thereon, whereby said background layer provides enhanced visual contrast to said legend layer.

* * * * *